United States Patent [19]

Handel et al.

[11] Patent Number: 4,631,528

[45] Date of Patent: Dec. 23, 1986

[54] PUSH BAR EXIT DEVICE WITH ALARM

[75] Inventors: Martin G. Handel, Newington; James E. Robida, Middletown; Ronald S. Slusarski, Berlin, all of Conn.

[73] Assignee: Emhart Industries, Inc., Farmington, Conn.

[21] Appl. No.: 656,828

[22] Filed: Oct. 2, 1984

[51] Int. Cl.[4] ..... G08B 13/08; E05B 65/10

[52] U.S. Cl. ..... 340/545; 292/21; 292/92; 340/693

[58] Field of Search ..... 340/545, 542, 693; 70/92, DIG. 49, 432; 292/21, 92, DIG. 53; 301/391, 392

[56] References Cited

U.S. PATENT DOCUMENTS

| | | | |
|---|---|---|---|
| 3,435,643 | 4/1969 | Pollak et al. | 292/92 X |
| 4,006,471 | 2/1977 | Pappas | 340/542 |
| 4,081,980 | 4/1978 | Hightower | 292/21 X |

*Primary Examiner*—James L. Rowland

*Assistant Examiner*—Anne Marie F. Capati

*Attorney, Agent, or Firm*—Barry E. Deutsch

[57] ABSTRACT

An emergency exit device of the push bar type to control entry and exit of personnel, including a crossbar which may be pushed toward a door to actuate mechanisms which retract a latch bolt, and an alarm and key system for selective alarm actuation. The alarm and key system includes internal control mechanisms which are mounted in a tamper-proof housing, which may be accessed only by operating the push bar and actuating the alarm. A light emitting diode in the alarm assembly indicates alarm state, the presence of power, and a preset delay interval for alarm actuation. A variety of internal and external key operation configurations may be employed. A fastening arrangement for the exit device housing provides security against unauthorized manipulation of alarm components. Where mounting the alarm assembly within the exit device frame, an internal mounted guard member may include a protection flange to block access to the alarm.

12 Claims, 13 Drawing Figures

OFF
ON

PUSH BAR EXIT DEVICE WITH ALARM

BACKGROUND OF THE INVENTION

The present invention relates to push bar exit devices for controlling ingress and egress, and more particularly to a tamper-resistant alarm to be employed in conjunction with such exit devices.

Emergency exit or panic bolt devices of the surface-mounted type are well known. These devices are mounted on the inner face of outwardly opening doors in public and commercial establishments where a number of strategically placed exits must afford quick exit without keys for the safety of personnel. One variety of these devices, the rim exit type, is exemplified by the apparatus disclosed in U.S. Pat. No. 3,877,262 to Williams, which is commonly assigned with the present patent application, and is herein incorporated by reference in its entirety. The Williams exit latch and actuator assembly includes a crossbar or push bar supported by parallel links which moves generally toward and away from the door, thereby permitting the user to retract a latch bolt by depressing the push bar.

Commonly assigned U.S. application Ser. No. 535,509, filed Sept. 26, 1983, discloses a door exit device of the push bar type having a streamlined design. This exit device incorporates a rear channel member having a latch bolt assembly at one end and a pair of spaced rails mounted thereto. The push bar extends outwardly of the channel member, with one or more links pivotally connected to the rails at one end for mounting the push bar in the channel.

Push bar emergency exit devices have in many cases incorporated an alarm which sounds locally or remotely, or both, when the push bar is depressed. This provides a valuable safeguard against clandestine exit by unauthorized personnel. It is appropriate that the alarm sound in most situations in which the panic bar is depressed, but it may be desirable to provide the facility for authorized personnel to override the alarm during ingress, or egress, or both.

Panic bar exit alarm apparatus which provides various modes of selective alarm actuation is disclosed in U.S. Pat. No. 4,006,471 to Pappas. The Pappas exit lock system incorporates an alarm assembly which is integrally manufactured with other components of the device. Many of the internal parts of this assembly are mounted directly to the back plate of the device and remain bolted to the door when the alarm housing, which is hinged to the back plate, is removed. A key and control cam mechanism is required to unhinge the alarm housing and gain access to the alarm components. This system is obviously incompatible with prior rim exit apparatus and does not permit retrofitting of a separate alarm module.

Accordingly, it is a primary object of the invention to provide an improved push bar type exit device incorporating an alarm. It is advantageous to provide an alarm in the form of a modular assembly, which may be retrofitted to preexisting rim exit devices and the like.

Another object of the invention is that such devices provide security against clandestine tampering with the alarm components. The improved exit device of the invention should facilitate access to internal alarm mechanisms by authorized personnel, yet protect against unauthorized access to such mechanisms.

A further object is to achieve a secure exit alarm device in a variety of configurations. As a related objective, it is desirable to provide a streamlined exit device which incorporates a temporary alarm without detracting from the compactness and mechanical efficiency of the device.

SUMMARY OF THE INVENTION

In furthering the above and additional objects, the invention provides improved push bar type emergency door exit devices which incorporate an alarm assembly in an efficient yet secure arrangement. A preferred construction of such devices includes a frame; a push bar mounted to the frame for relative movement between an extended position and a depressed position; a latch bolt assembly at one end of the frame for retracting the latch bolt in response to movement of the push bar toward its depressed position; and the alarm assembly. A housing for the alarm assembly contains its elements and shields them from manipulation. Means are provided for fastening the alarm housing to the frame so that these may not be separated without moving the push bar toward its depressed position. In the preferred embodiment, the frame of such device comprises a channelled member for mounting of the push bar and other structures.

One embodiment of the invention relates to an advantageous design of a modular alarm system which may be retrofitted to prior existing push bar exit devices. The alarm housing is profiled for mounting at the one end of a push bar, in the vicinity of the latch bolt assembly such as that described in U.S. Pat. No. 3,877,262. Depressing the push bar causes a retraction finger to pivot a retraction lever which acts upon the latch bolt. A pin appended to the latch bolt moves within an arcuate slot during retraction or projection of the latch bolt, thereby opening or closing a switch to actuate the alarm. The alarm housing is mounted to its frame, in part, by means of a specially profiled tang which is inaccessible except when the bar is depressed.

A second embodiment of the invention pertains to an improved version of the exit device of U.S. application Ser. No. 535,509. This device includes a skirt portion the length of which may be varied in accordance with the width of the door to which the device is to be mounted. In the exit device of this embodiment the alarm assembly is housed within said skirt portion. A guard member mounted to the inside of the skirt portion prevents unauthorized access to alarm components due to a flange which effectively blocks one end of the exit device if a cover is removed. Attempted removal of the guard member is prevented by a hook mounted to the push bar, which hook fits within an aperture in the guard member. While the push bar is in its elevated or extended position, a portion of the hook abuts against a lip of the guard member adjacent the aperture, thereby preventing sliding of the skirt portion cover relative to the channelled frame. This fastening arrangement cannot be circumvented without depressing the push bar, thereby unlatching the hook. As a secondary feature, a two piece mounting clamp for the end cap permits sliding removal of alarm components without the need for removing the device from the door.

BRIEF DESCRIPTION OF THE DRAWINGS

The above and additional aspects of the invention are illustrated in the following detailed description, which is to be taken in conjunction with the drawings in which.

DETAILED DESCRIPTION

Figures 1, 2, 4:
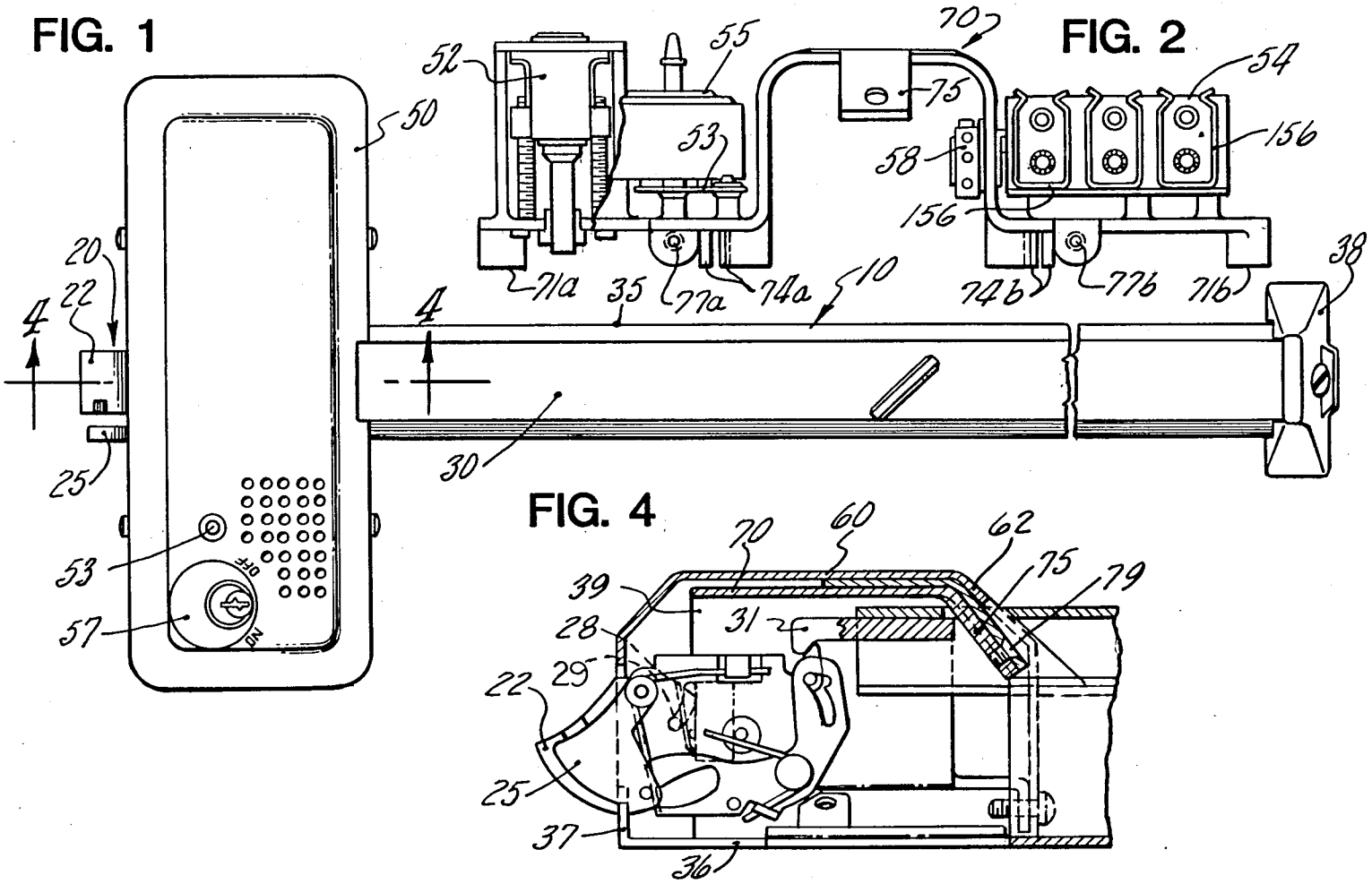
FIG. 1 is a plan view of a rim exit device with modular alarm assembly, according to a first embodiment of the invention.
FIG. 2 is a side perspective view of an alarm frame assembly from the apparatus of FIG. 1.
FIG. 4 is a side sectional view of the latch bolt assembly of the device of FIG. 1, taken along the lines 4—4, with the push bar elevated.

Reference should now be had to FIGS. 1–5 for a detailed description of a push bar door exit device in accordance with a first embodiment of the invention. FIG. 1 illustrates a rim or surface mounted type exit device 10 which is readily installable on the inner face of an outwardly opening door. Device 10 in its overall construction is similar to the rim exit device disclosed in U.S. Pat. No. 3,877,262, with the principal difference of the inclusion of a modular alarm assembly 50, described in detail below. Although the embodiments disclosed herein show door exit devices of the rim type, the present invention may also be used with vertical rod type door exit devices. Exit device 10 includes a frame member 35 which supports crossbar 30 and alarm assembly 50. Alarm assembly 50 is configured to be fitted around that end of device 10 housing the latch bolt assembly 20 including latch bolt 22 and auxilliary latch bolt 25. Crossbar 30 is mounted in channelled frame 35, both of which may be cut to required length to span the width of the inner face of a door (not shown), without impairing the mechanical functioning of these structures. The rear end portion of the frame member 35 is secured to the inner face of a door by a clamp plate (not shown) concealed by a cover 38 in holding engagement with frame member 35.

Figure 3A:
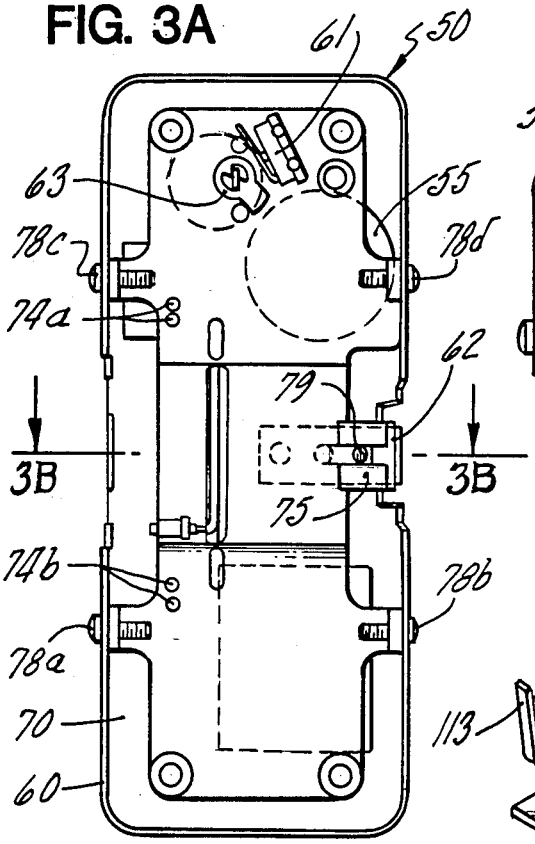
FIG. 3A is a bottom plan view of the alarm assembly of FIG. 1, as seen from the inside.
Figure 3B:
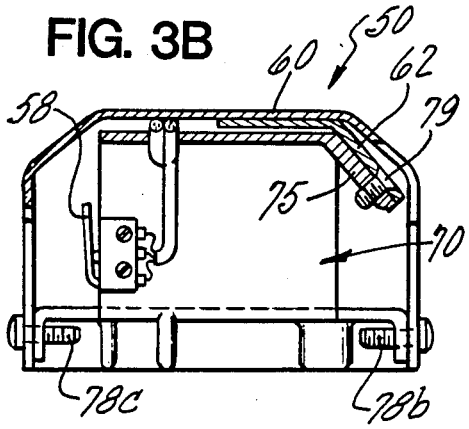
FIG. 3B is a side sectional view of the alarm assembly taken along the section 3B—3B of FIG. 3A.
Figure 8B:
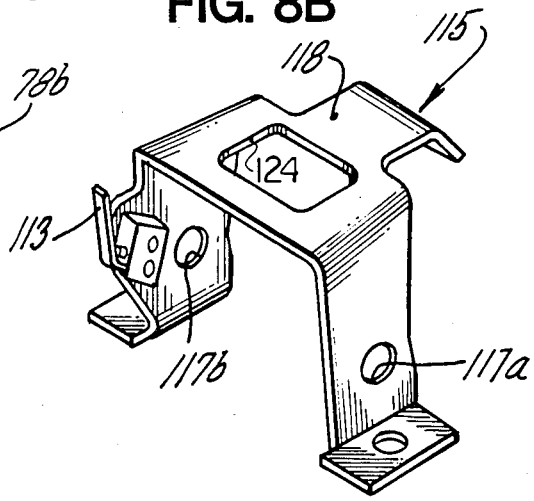
FIG. 8B is an isolated view of the latchbolt housing support from the apparatus of FIG. 8A.

With reference to FIGS. 2, 3A, and 3B, alarm assembly 50 is designed as a modular structure including a cover 60 (FIGS. 3A, 3B), and a frame 70 (FIG. 2) for supporting the various internal alarm components and for mounting these to the exit device frame 35. As seen from the front in FIG. 2, alarm assembly 50 includes a lock cylinder assembly 52 for arming and disarming the lock; and light-emitting diode 53 which provides an indication of alarm state, the presence of power, and a preset delay interval for alarm actuation.

As seen from the side in FIG. 2, the alarm frame 70 comprises a die cast metal structure which is fastened to the door at posts 71*a*–71*d* (only two shown here). Suitable mounting structures such as posts 74*a*, 74*b* provide a snug fit of lock assembly 50 around the other structures of exit device 10. Alarm frame 70 supports the cylinder assembly 52, circuit board 53, battery pack mount 54 (batteries are not shown) and local alarm 55. Circuit board 53 communicates with battery pack 54, switch 58, and with an arm/disarm switch 61 (FIG. 3A) at the bottom of frame 70. Switch 61 is opened or closed by the rotation of cam 63 using a key inserted within lock cylinder 52. Frame 70 also includes an integral tang 75, which along with flanges 77*a*–77*d* (only two seen in FIG. 2) provides mounting surfaces for the alarm cover 60, and for coupling alarm assembly 50 to the remainder of exit device 10.

FIGS. 3A and 3B give two views of the alarm assembly 50 showing the manner in which the alarm frame 70 is joined to cover 60. These two structures are fastened together by screws 78*a*–78*d* through apertures in the cover 60 and frame flanges 77*a*–77*d*. In addition, cover 60 includes a tang 62 which is complementary to the tang 75 on frame 70, so that a secure frame-cover connection is formed by a screw 79 inserted through apertures in these tangs. Tangs 62, 75 are located so as to be accessible only by depressing cross bar 30 (compare FIGS. 4, 5); therefore the internal components of alarm assembly 50 are inaccessible except by depressing push bar 30 and actuating alarm 55.

Figure 5:
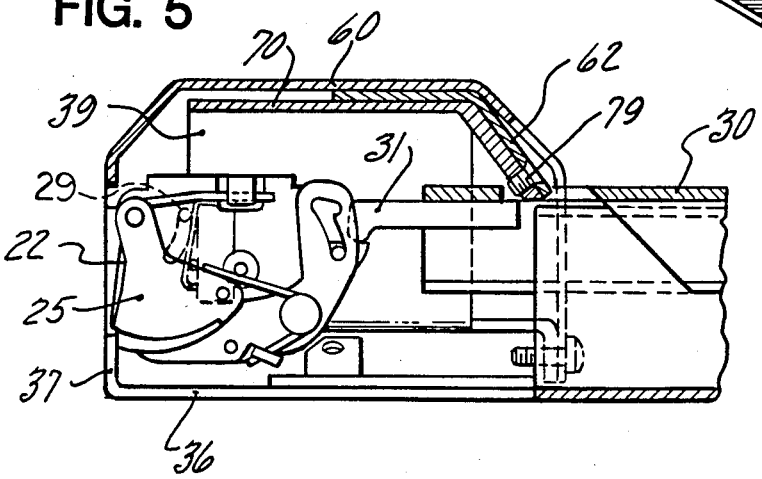
FIG. 5 shows the latch bolt assembly of FIG. 4, with the push bar depressed.

FIGS. 4 and 5 depict the latch bolt assembly 20 of the exit device 10 showing the manner in which pressing crossbar 30 actuates switch 58 (also seen in FIG. 2). Latch bolt assembly 20 is generally of the design disclosed in U.S. Pat. No. 3,877,262, and includes a sheet metal mounting plate 36 which has an inwardly bent portion 37 forming a face plate for the bolt mechanism and having an aperture 38 to receive the latch bolt 22 therethrough. The frame further includes a generally U-shaped support bracket 39 (here seen from the side) which is mounted on plate 36 adjacent portion 37. Mounting plate 36 and support bracket 39 form a box-like structure which opens rearwardly or toward the crossbar 30. The latch bolt 22 is pivotally supported within the box-like frame and is actuated by the depression of crossbar 30 using the mechanical arrangement disclosed in detail in U.S. Pat. No. 3,877,262, which is herein incorporated by reference. This arrangement relies upon the downward motion of retractor finger 31 attached to push bar 30, which acts upon a retractor lever (not shown) to pivotally retract the latch bolt 22. In the view of FIGS. 4 and 5, the near wall of U-shaped bracket 39 houses mechanisms for controlling the deadlocking mechanisms including the auxiliary latch bolt 25. The far wall of support 39, as shown in phantom in FIGS. 4 and 5, includes an arcuate slot 28 through which extends a pin 29 appended to latch bolt 22. The pivotal retraction of latch bolt 22 causes the upward movement of pin 29 within arcuate slot 28, turning on switch 58. Therefore, as may be seen by comparing FIGS. 4 and 5, the depression of push bar 30 not only acts upon the latch bolt 22 using the linkage of U.S. Pat. No. 3,877,262, but also mechanically actuates switch 58 to set off the alarm 55.

Figure 6:
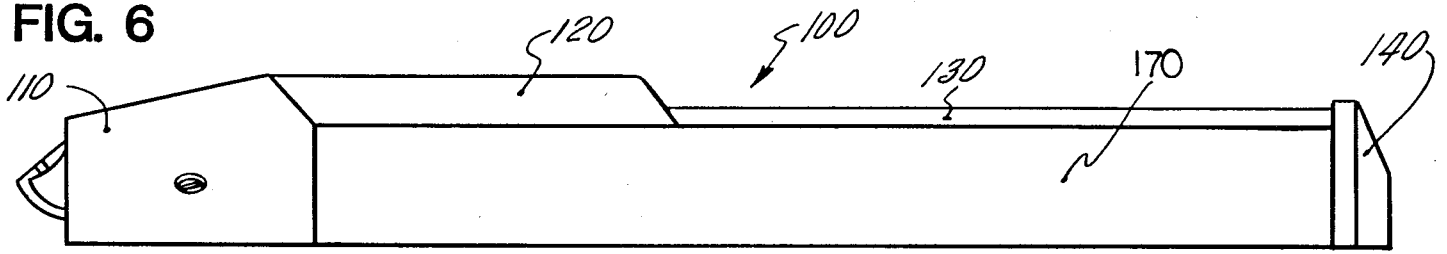
FIG. 6 is a side perspective view of an exit device according to a second embodiment of the invention.
Figure 7:
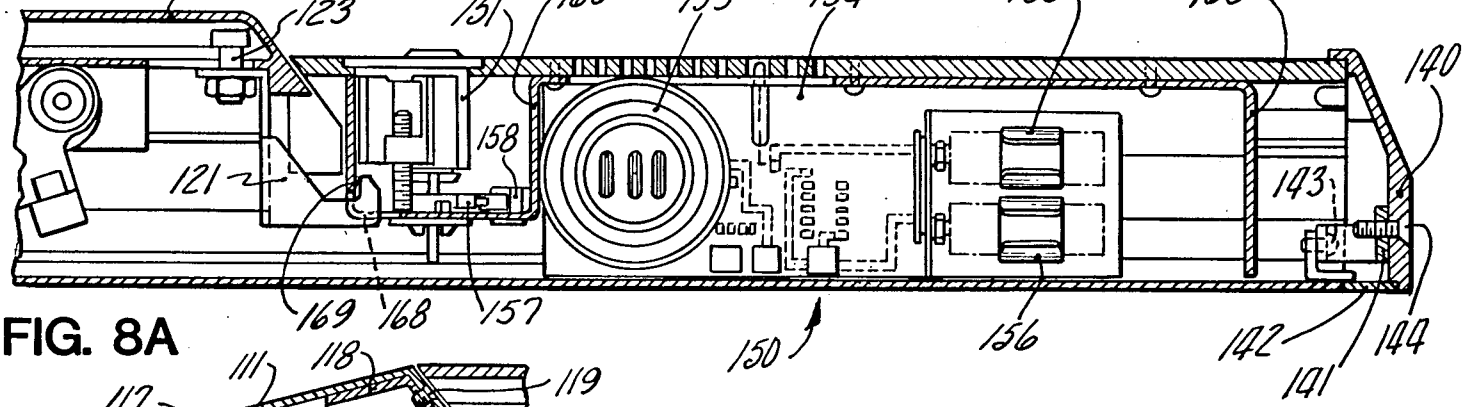
FIG. 7 is a side sectional view of the skirt portion of the device of FIG. 6.
Figure 8A:
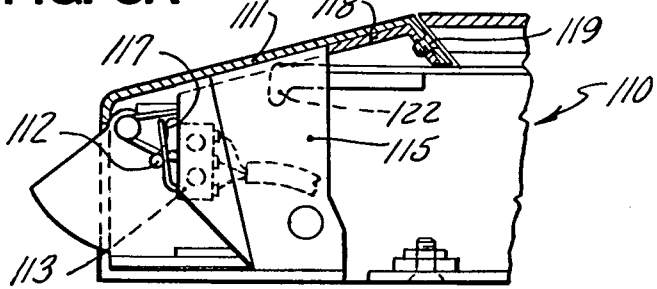
FIG. 8A is a side sectional view of the latch bolt portion of the device of FIG. 6.
Figure 9:
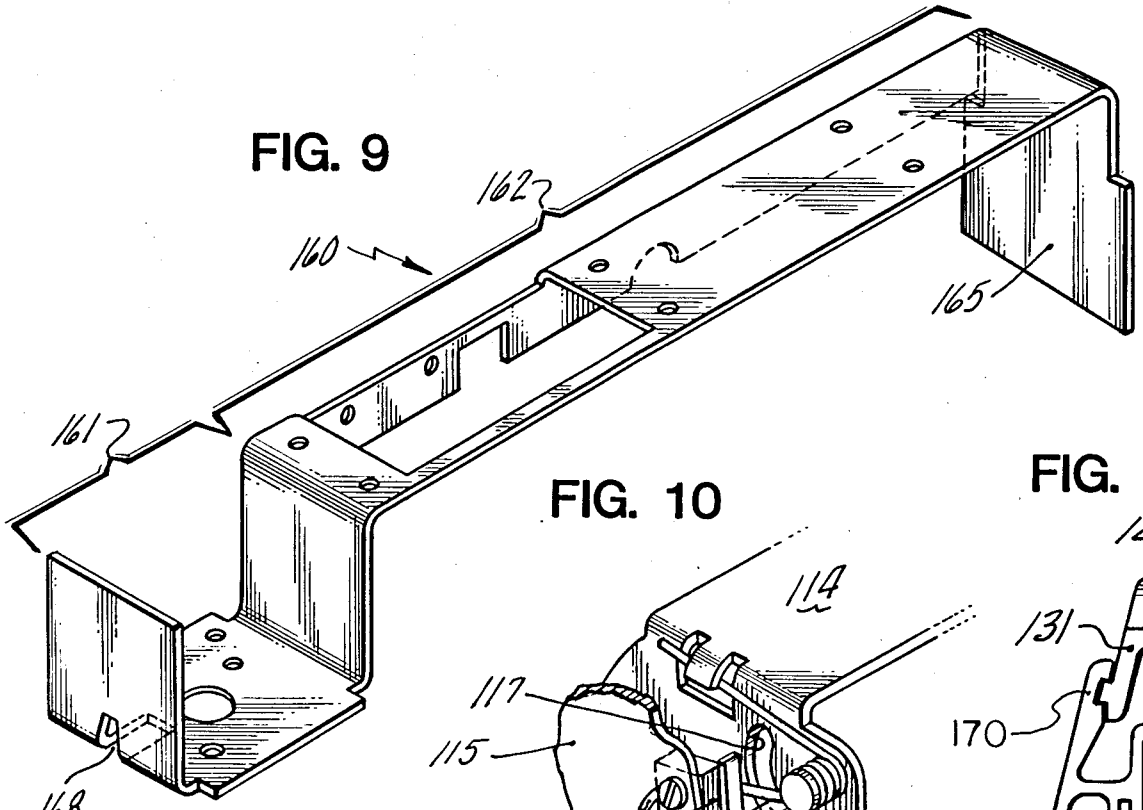
FIG. 9 is an isolated perspective view of the alarm guard member taken from the device of FIG. 6.
Figure 10:
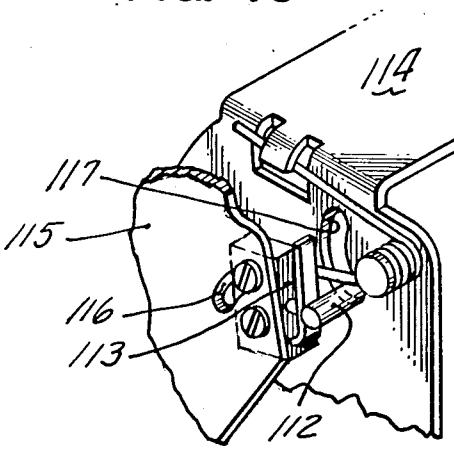
FIG. 10 is a perspective view of alarm switch actuating mechanisms for the device of FIG. 6.

Reference should now had to FIGS. 6–11, which illustrates an exit device 100 in accordance with an alternative embodiment of the invention. FIG. 6 gives a side perspective view of exit rim device 100, which is generally in accordance with commonly assigned U.S. application Ser. No. 535,509 filed Dec. 26, 1983. This device includes a latch bolt assembly 110, push bar 120, and rearwardly located skirt portion 130 with end cap 140. These various assemblies are mounted in a channelled frame 170 which is in turn mounted to a door. Latch bolt assembly 110 and push bar 120 are of a generally similar design and operation to the corresponding structures of the device 10 of FIGS. 1–5, and will not be discussed below in detail, except as to the aspect illustrated in FIGS. 8A, 8B. FIG. 8A shows an alternative mechanical connection between the push bar operation and the actuation of the alarm, the latter being located within an alarm assembly contained within the skirt portion 130, as discussed below. Assembly 110 incorporates a support member 115 which is shown in perspective in FIG. 8B. Support 115 is of a generally inverse-U lateral cross-section, and has an inclined upper face matching the upper surface of the cover plate 111 of latch bolt assembly 110. Support 115 is proportioned to fit over a latch bolt actuating assembly which is virtually identical to the assembly of U.S. Pat. No. 3,877,262. The upper face of support 115 includes a rectangular aperture 124 to provide a clearance region for the retractor finger 122 which links the push bar 120 to the other mechanisms of the latch bolt actuating assembly 110. A switch 113 which is functionally analogous to the switch 58 of the device of FIGS. 1–5 is mounted to one leg of support 115. The support 115 also includes a tang 118, which fits against a sloping rim of assembly cover 111, so that these structures may be fastened together by means of a screw 119 through apertures in the tang 118 and cover 111. Therefore, as best seen in the perspective view of FIG. 10,the depression of push bar 120 causes a pin extention 112 of the latch bolt to ride up in an arcuate slot 117, thereby closing the switch 113 and setting off the alarm 153 (FIG. 7). The position of switch 113 may be adjusted through its mounting in slot 116, thereby controlling the sensitivity of this switch to the displacement of push bar 120 and latch bolt.

It is practically impossible to disable the alarm of exit device 100 without notice to security personnel, inasmuch as it is required to gain access to the switch 113 to remove the latch bolt assembly cover 111. Cover 111 is secured to the support 115 by means of screws through apertures 117*a* and 117*b* at each side of the device (FIG. 8B), and also by means of the screw 119 which passes through tang 118. The latter screw is inaccessable except by depressing the push bar 120, thereby setting off the alarm.

In the apparatus 100, which is generally of a streamlined design, the components of alarm assembly 150 are contained within the skirt portion 130. The arm assembly housing comprises in part of the skirt portion cover 131, which is slidably mounted in the channelled frame 170 by means of a mating between flanges on the skirt cover 131 and channels within frame 170. The components of alarm assembly 150 are mounted to a guard member 160 which is shown in an isolated perspective view in FIG. 9. Guard 160 includes a forward, generally U-shaped portion 161; a flat upper portion 162 at which guard 160 is mounted to the skirt portion cover 131; and a rear, vertically extending flange 165. As shown in FIG. 7, the lock cylinder assembly 151 and arm/disarm switch 158 are mounted on the U-shaped portion 161 of guard 160 in a cooperative relationship wherein a turning of the key within lock cylinder 151 causes the rotation of cam 157 to close switch 158. The intermediate region 162 of guard 160 houses alarm 153, circuit board 154, and battery pack 156.

Figure 11:
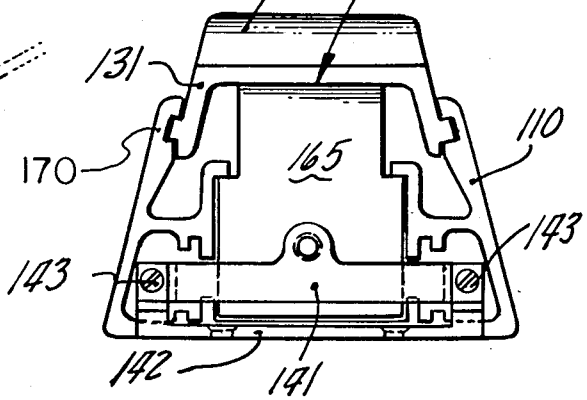
FIG. 11 is an elevational view of the device of FIG. 6, as seen from the skirt end with its end cap removed.

All of the internal stuctures are protected from tampering by removal of the rear cover cap 140 by means of the flange 165, as best seen in FIG. 11. Furthermore, access to the alarm components by means of the sliding removal of skirt portion cover 131 is prevented by a security hook 121 which acts as a fastener between push bar 120 and alarm guard 160. As shown in FIG. 7, hook 121 is securely mounted by bolt 123 to the rear end of push bar 120. Hook 121 fits within a slot 168 at one end of guard member 160. When push bar 120 is at its normal, elevated position, the upwardly projecting portion of hook 121 abuts against a lip 169 adjacent slot 168, and prevents the rearward sliding of the skirt cover 131. It is only when depressing push bar 120 that hook 121 clears the slot 168 and permits rearward movement of guard member 160 and skirt cover 131.

The rear end of exit device 100 is mounted to a door, and end cap 140 is held, by an improved two-piece mounting bracket consisting of a base portion 142 and an upper portion 141 (FIGS. 7, 11). Device 100 is mounted to a door by screws (not shown) through bracket base 142, while end cap 140 is attached via screws 144 through upper portion 141. When it is desired to gain access to the alarm assembly 150, such as to replace batteries in battery pack 156, the end cap 140 is removed, and upper bracket portion 141 is unfastened by removing screws 143. As may best be seen with reference to FIG. 11, this arrangement permits the sliding removal of guard member 160 and the alarm components it supports, without the necessity of removing device 100 from the door. The specific embodiments described herein are intended for the purpose of illustration and are not intended to imply any limitation. A variety of tamper-resistant alarm housing arrangments have been described, generally in furtherance of the objectives of providing simple, efficient methods for mounting and housing the elements of an alarm assembly in an exit device, in which clandestine access to these elements is difficult if not impossible. These and all other variations and modifications of this invention within the scope of the appended claims are considered to constitute a part of this invention.

We claim:

1. An improved exit device for doors, said device including a frame, a push bar mounted to the frame for relative movement between an extended position and a depressed position, and a latch bolt assembly at one end of the frame having mechanisns for retracting the latch bolt in response to the movement of said push bar toward its depressed position, in which the improvement comprises:

an alarm assembly including an electrically actuated alarm, means for actuating the alarm in response to the movement of said push bar, and means for controlling the actuation of said alarm in response to an externally operable switch;

a housing for said alarm assembly which contains its elements and shields them from manipulation; and means for fastening the alarm housing to said frame, with said push bar when in its extended position shielding said fastening means and when in its depressed position, permitting access to said fastening means to permit separation of said alarm housing from said frame.

2. An exit device as defined in claim 1, wherein the alarm assembly and its housing are a modular assembly which is fitted around the other elements of the exit device.

3. An exit device as defined in claim 1, wherein the alarm assembly is contained within the frame.

4. An exit device as defined in claim 1, wherein the fastening means comprises a mounting flange integral with the alarm housing and closely spaced from one end of the push bar, and means for demountably coupling the mounting flange to the frame, and wherein the push bar when in its extended position blocks access to the demountable coupling, and when in it depressed position permits access to the demountable coupling.

5. An exit device as defined in claim 1, wherein the alarm housing is slidably mounted to the frame, and the fastening means comprises a guard member secured to the alarm housing and including an aperture, and a hook member attached to said push bar which fits within the aperture, wherein the hook member abuts against the guard member to prevent sliding of the alarm housing when the push bar is extended, and the hook member clears the aperture when the push bar is depressed, allowing sliding of the housing.

6. An exit device as defined in claim 5 wherein the apertured member supports the alarm assembly elements.

7. An exit device as defined in claim 6 wherein the apertured member includes a guard portion which shields the alarm components from manipulation.

8. An exit device as defined in claim 5, further comprising a two-piece bracket for mounting the device to a door adjacent the guard member and for securing an end cap, including one bracket piece which may be removed to permit sliding removal of the guard member without unfastening the device from the door.

9. An improved exit device for doors, said device including a channelled frame, a push bar mounted to the frame for relative movement between an extended position and a depressed position, and a latch bolt assembly at one end of the frame having mechanisms for retracting the latch bolt in response to the movement of said push bar toward its depressed position, in which the improvement comprises:

an alarm assembly including an electrically actuated alarm, means for actuating the alarm in response to the movement of said push bar, and means for controlling the actuation of said alarm in response to an externally operable switch;

a housing for the alarm assembly which contains its elements in cooperation with the frame, said housing being slidably mounted to said channelled frame;

a guard member mounted within said housing and including an aperture; and a hook member attached to the push bar, wherein said hook member fits within the guard member aperture when the push bar is in its extended position preventing sliding of the housing relative to the frame, and wherein the hook member clears the aperture when the push bar is in its depressed position permitting sliding of the housing relative to the frame.

10. An exit device as defined in claim 9 wherein the alarm housing includes a skirt portion cover mounted to the frame adjacent the push bar.

11. An exit device as defined in claim 10 wherein the guard member includes a flange portion at an end remote from the push bar, said flange portion blocking access to the alarm assembly elements.

12. An exit device as defined in claim 9, further comprising a two piece bracket for mounting the device to a door adjacent the guard member and for securing an end cap, including one bracket piece which may be removed to permit sliding removal of the guard member without unfastening the device from the door.

* * * * *